United States Patent [19]

Fukasawa et al.

[11] Patent Number: 4,692,725

[45] Date of Patent: Sep. 8, 1987

[54] DIELECTRIC FILTER HAVING TRIMMABLE CAPACITOR

[75] Inventors: Atsushi Fukasawa; Kenichiro Hosoda; Takuro Sato; Tatumasa Yoshida, all of Tokyo, Japan

[73] Assignee: OKI Electronics Co., Ltd., Tokyo, Japan

[21] Appl. No.: 749,185

[22] Filed: Jun. 26, 1985

Related U.S. Application Data

[63] Continuation of Ser. No. 490,881, May 2, 1983, Pat. No. 4,546,333.

[30] Foreign Application Priority Data

May 10, 1982 [JP] Japan ..... 57-76565

[51] Int. Cl.[4] ..... H01P 1/205

[52] U.S. Cl. ..... 333/203; 333/207; 333/223; 333/263

[58] Field of Search ..... 333/202-212, 333/219, 222-224, 235, 263

[56] References Cited

U.S. PATENT DOCUMENTS 3,947,934 4/1976 Olson ..... 333/175 X
4,268,809 5/1981 Makimoto et al. ..... 333/202
4,431,977 2/1984 Sokola et al. ..... 333/207 X

FOREIGN PATENT DOCUMENTS 0038996 11/1981 European Pat. Off. ..... 333/202

*Primary Examiner*—Paul Gensler
*Attorney, Agent, or Firm*—Ratner & Prestia

[57] ABSTRACT

A dielectric filter (FIG. 16) for frequencies higher than VHF band comprising a closed conductive housing (112), a pair of input and output means provided at both the extreme ends of said housing (112), a dielectric body (111) with a plurality of linear parallel grooves (118) arranged in said housing (112), a plurality of conductive linear means (113) with the length of approximately $\frac{1}{4}$ wavelength mounted in said dielectric body (111) between said grooves (118) so that one end of said resonators (113) is fixed to the common plane of the housing (112), a capacitor means (114, 115) provided between the other end of resonators (111,113,118) and said conductive housing (112) so that an electrode (115) of said capacitor may be trimmed by a laser beam to adjust the resonating frequency of each of said resonators (111,113,118) and a plurality of conductive rods (137) provided in said grooves (118) for improving the spurious characteristics of the filter.

8 Claims, 31 Drawing Figures

Fig. 12
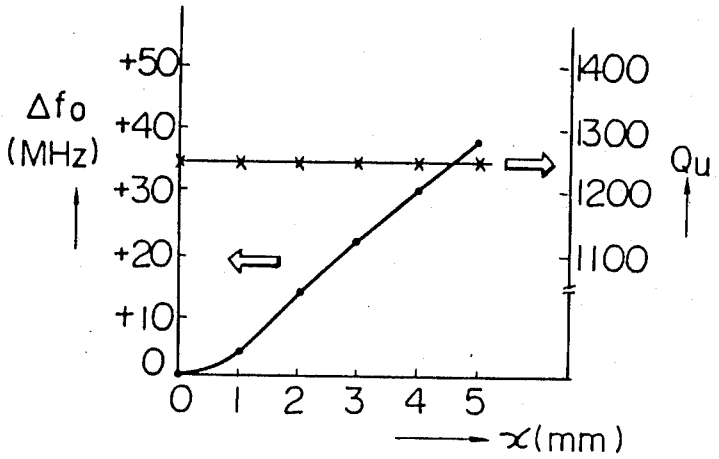
Fig. 13 A
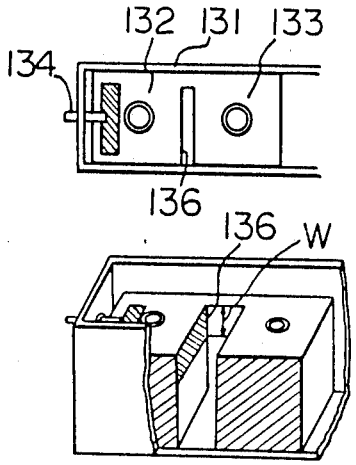
Fig. 13C
Fig. 13 B
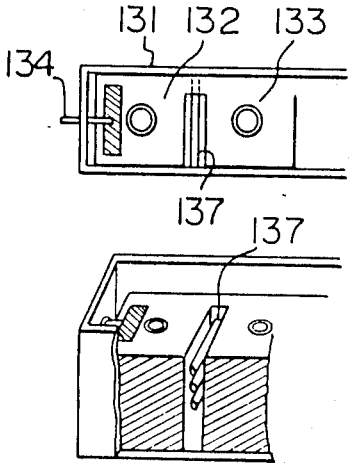
Fig. 13D

Fig. 14A
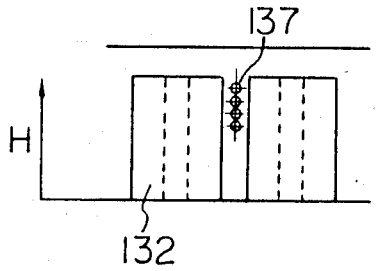
Fig. 14B
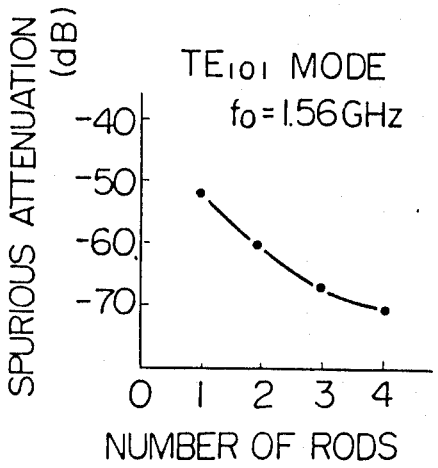
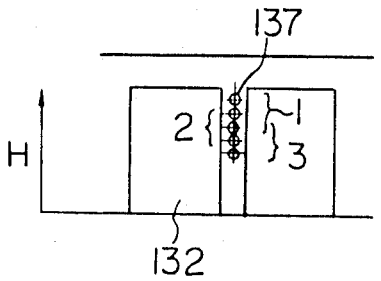
Fig. 15A
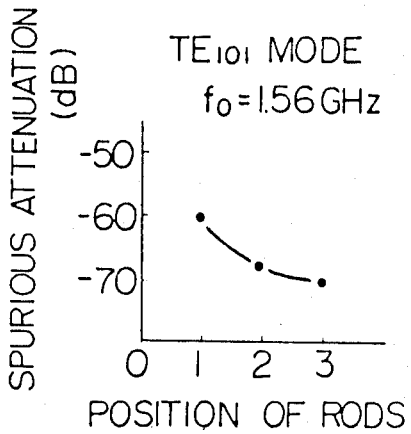
Fig. 15B

DIELECTRIC FILTER HAVING TRIMMABLE CAPACITOR

This application is a continuation of application Ser. No. 490,881, filed May 2, 1983, and now U.S. Pat. No. 4,546,333.

BACKGROUND OF THE INVENTION

The present invention relates to a high frequency dielectric filter, in particular, relates to a novel structure of a bandpass filter of dielectric waveguide type, which is suitable for use especially in the range from the VHF bands to the comparatively low frequency microwave bands. The present filter relates particularly to such a filter having a plurality of resonator rods each coupled electrically and/or magnetically with the adjacent resonators, and can be conveniently installed in a mobile communication system.

Such kind of filters must satisfy the requirements that the size is small, the energy loss in a high frequency is small, the manufacturing process is simple, and the characteristics are stable.

When a filter is composed of a plurality of elongated rod resonators, the size of each resonator and the coupling between resonators must be considered.

First, three prior filters for the use of said frequency bands will be described.

FIG. 1A shows the perspective view of a conventional interdigital filter, which has been widely utilized in the VHF bands and the low frequency microwave bands. In the figure, the reference numerals 1-1 through 1-5 are resonating rods which are made of conductive material, 2-1 through 2-4 are gaps between adjacent resonating rods, and 3 is a case. 3-1 through 3-3 are conductive walls of said case 3. A cover of the case 3 is not shown for the sake of the simplicity of the drawing. A pair of exciting antennas 4 are provided for the coupling of the filter with an external circuit. The length of each illustrated resonating rod 1-1 through 1-5 is selected at to be substantially equivalent to one quarter of a wavelength, and one end of the resonating rods are short-circuited alternately to the confronting conductive walls 3-1 and 3-2, while the opposite ends thereof are free standing.

As is well known, when a resonator stands on a conductive plane, a magnetic flux distributes so that the density of the magnetic flux is maximum at the foot of the resonator, and is zero at the top of the resonator, while the electrical field distributes so that said field is maximum at the top of the resonator and the field at the foot of the resonator is zero. Therefore, when a pair of resonators are mounted on a single conductive plane, those resonators are coupled with each other magnetically and electrically, and the magnetic coupling is performed at the foot of the resonators, and the electrical coupling is performed at the top of the resonators. However, since the absolute value of the magnetic coupling is the same as that of the electrical coupling, and the sign of the former is opposite to the latter, the magnetic coupling is completely cancelled by the electrical coupling, and as a result, no coupling is obtained between two resonators.

In order to solve that problem, an interdigital filter arranges the resonators alternately on a pair of confronting conductive walls. In that case, the two adjacent resonators are electrically coupled with each other as shown in FIG. 1B, where the magnetic flux M which has the maximum value at the foot of the resonator does not contribute to the coupling of the two resonators since the foot of the first resonator 1-1 is located far from the foot of the second resonator 1-2, and so, only the electrical field E contributes to the coupling of the two resonators.

However, said interdigital filter has the disadvantage that the manufacture of the filter is cumbersome and subsequently the filter is costly, since each of the resonating rods are fixed alternately to the confronting two conductive walls to obtain a high enough coupling coefficient between each of the resonating rods.

FIG. 2 shows the perspective view of another conventional filter, which is called a comb-line type filter, and has been utilized in the VHF bands and the low frequency microwave bands. In the figure, the reference numerals 11-1 through 11-5 are conductive resonating rods with one end thereof left free standing while opposite and thereof short-circuited to the single conductive wall 13-1 of a conductive case 13. The length of each resonating rod 11-1 through 11-5 is selected to be a little shorter than a quarter of a wavelength. The resonating rod acts as inductance (L), and capacitance (C) is provided at the head of each resonating rod for providing the resonating condition. In FIG. 2, said capacitance is accomplished by the dielectric disks **11*a*-1 through 11*a*-5 and the conductive bottom wall 13-2 of the case 13. The gaps 12-1 through 12-4 between each of the resonating rods, and the capacitance between the dielectric disks 11*a*-1 through 11*a*-5, and the bottom wall 13-2 provide the necessary coupling between each of the resonating rods. A pair of antennas 14** are provided for the coupling between the filter and external circuits.

With this type of filter, the resonating rods 11-1 through 11-5 are fixed on the single bottom wall 13-1 and the manufacturing cost can be reduced as far as this point is concerned, but there is the shortcoming in that the manufacture of the capacitance (C) with an accuracy of, for instance, several %, is rather difficult, resulting in no cost merit. Therefore, the advantage of a comb-line type filter is merely that it can be made smaller than an interdigital filter.

Further, although we try to shorten the resonators in the filters of FIG. 1A and/or FIG. 2 by filling dielectric material in a housing, it is almost impossible since the structure of the filters are complicated. It should be noted that the material of the dielectric body for the use of a high frequency filter is ceramic for obtaining the small high frequency loss, and it is difficult to manufacture the ceramic with the complicated structure to cover the interdigital electrodes of FIG. 1A, or the combination of the disks and the rods of FIG. 2. If we try to fill the housing with plastic, the high frequency loss by plastic would be larger than the allowable upper limit.

Further, a dielectric filter which has a plurality of dielectric resonators has been known. However, a dielectric filter has the shortcoming that the size of each resonator is rather large even when the dielectric constant of the material of the resonators is the largest possible.

Accordingly, the present applicant has proposed the filter having the structure of FIG. 3A (U.S. Ser. Nos. 92,670, now U.S. Pat. No. 4,283,697 and 37,419, now U.S. Pat. No. 4,255,729, Canadian application No. 339,477, GB Ser. No. 7940057, West Germany No. P29 46 836.8, France No. 79 28588, Holland No. 7908381, Sweden No. 7909747-7, Canada No. 326,986, and EPC No. 79101456.6). In FIG. 3A, each resonator has a circular center conductor (31-1 through 31-5), and the cylindrical dielectric body (**31*a*-1 through 31*a*-5) covering the related center conductor, and each of the resonators are fixed on the single conductive plane 33-1 of the housing 33, leaving the air gaps (32-1 through 32-4) between the resonators. 34 are antennas for coupling the filter with external circuits. The case 33 has the closed conductive walls having the walls 33-1, 33-2, and 33-3** (upper cover wall is not shown). The structure of the filter of FIG. 3A has the advantage that the length L of a resonator is shortened due to the presence of the dielectric body covering the conductor, and the resonators are coupled with each other although the resonators are fixed on a single conductive plane due to the presence of the dielectric bodies covering the center conductors.

When the two resonators contact with each other as shown in FIG. 3B, those resonators do not couple with each other, because the electrical coupling between the two resonators is completely cancelled by the magnetical coupling between the two resonators. In this case, the dielectric covering 31-1 and 31-2 do not contribute to the coupling between the resonators. On the other hand, when an air space 32-1 is provided between the surfaces of the dielectric bodies 31-1 and 31-2 as shown in FIG. 3C, some electric field (p) originated from one resonator is curved at the surface of the dielectric body (the border between the dielectric body and the air), due to the difference of the dielectric constants of the dielectric body 31-1 or 31-2, and the air, so that the electric field is directed to an upper or bottom conductive wall. That is to say, the electric field (p) leaks, and the electrical coupling between the two resonators is decreased, and so that decreased electrical coupling can not cancel all the magnetic coupling which is not affected by the presence of the dielectric cover. Accordingly, the two resonators are coupled magnetically by the amount equal to the decrease of the electrical coupling. That decrease of the electrical coupling is caused by the leak of the electrical field at the border between the dielectric surface and the air, due to the presence of the air gap 32-1.

The leak of the electric field to an upper and/or bottom conductive wall increases with the length (x) between the two resonators. Therefore, the overall coupling between resonators which is the difference between the magnetic coupling and the electrical coupling increases with the length (x) so long as that value (x) is smaller than the predetermined value ($x_0$). When the length (x) exceeds that value ($x_0$), the absolute value of both the electrical coupling and the magnetic coupling becomes small, and so the total coupling decreases with the length (x).

However, we found that the filter of FIG. 3A has the disadvantage that the leak (p) of the electrical field to an upper and/or bottom wall is considerably affected by the manufacturing error of both the housing and the dielectric cover. That is to say, the small error of the gap between the upper and/or bottom wall and the dielectric cover, and/or the small error of the size of the dielectric cover provides much error for the characteristics of the filter. Further, the filter is sometimes unstable since the resonators are fixed only at one end of them.

Further, we found that the coupling coefficient between resonators is not enough for providing a wideband filter.

Further, the dielectric filter in FIGS. 3A through 3C has the disadvantages that the length of conductive rods **31*a*-1 through 31*a*-5** must be very accurate, and the small error in the length of those conductive rods provides much error in the characteristics of the filter.

SUMMARY OF THE INVENTION

It is an object, therefore, of the present invention to overcome the disadvantages and limitations of a prior dielectric filter of the type of FIGS. 3A through 3C by providing a new and improved dielectric filter.

It is also an object of the present invention to provide a new and improved dielectric filter which is simple in structure, easy to adjust the characteristics of the filter, and/or the resonating frequency of the resonators, and has small spurious characteristics.

The above and other objects are attained by a dielectric filter comprising (a) a conductive closed housing, (b) at least two resonators fixed in said housing, (c) an input means for coupling one end resonator of said at least two resonators to an external circuit, and an output means for coupling the other end resonator of said at least two resonators to an external circuit, (d) each resonator comprising an elongated linear inner conductor one end of which is fixed commonly at the bottom of said housing, and the other end of which is free standing, and a dielectric body surrounding said inner conductor, (e) the thickness of said dielectric body surrounding said inner conductor being sufficient to hold all the electromagnetic energy in the dielectric body except for the energy for coupling between two adjacent resonators, and (f) an air gap is provided between adjacent resonators, (g) said dielectric body (111) surrounding inner conductor (113) is a bulk body common to all the resonators with a groove (118) between two adjacent resonators, and said groove (118) operates as said air gap between resonators for effecting coupling between the resonators, (h) a capacitor with a trimming electrode (115) is provided at the free end of the inner conductor (113) of each resonator for finely adjusting resonating frequency of the resonator.

BRIEF DESCRIPTION OF THE DRAWINGS

The foregoing and other objects, features, and attendant advantages of the present invention will be appreciated as the same become better understood by means of the following description and accompanying drawings wherein;

FIG. 12 shows the characteristics of the filter of FIGS. 11A through 11F, FIG. 13A, FIG. 13B FIG. 13C, and FIG. 13D are other embodiments of the dielectric filter according to the present invention, FIGS. 14A, B and FIGS. 15A, B show the characteristics of the embodiments of the filters of FIG. 13A, FIG. 13B, FIG. 13C, and FIG. 13D.

DESCRIPTION OF THE PREFERRED EMBODIMENTS

Figure 3A:
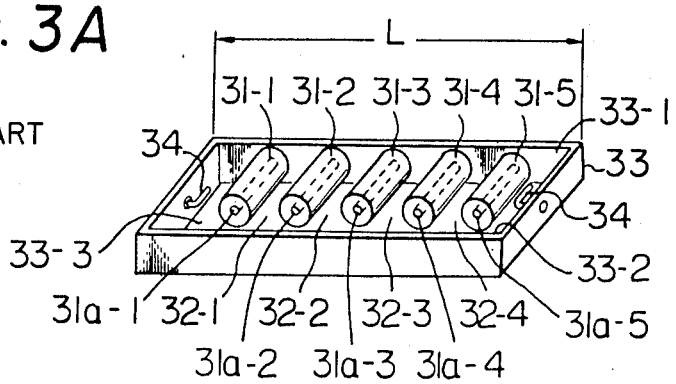
Fig. 3A PRIOR ART
FIG. 3A shows the structure of a prior dielectric filter having resonators with inner conductors and a circular dielectric cover.
Figure 3B:
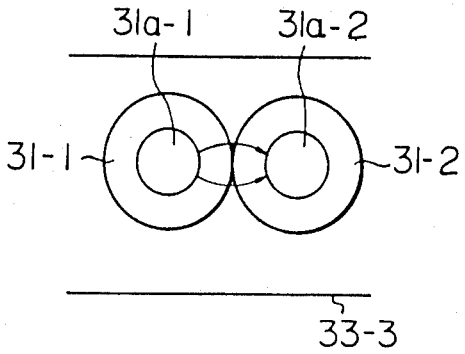
Fig. 3B PRIOR ART
FIG. 3B and FIG. 3C show the coupling principle of the filter of FIG. 3A.
Figure 3C:
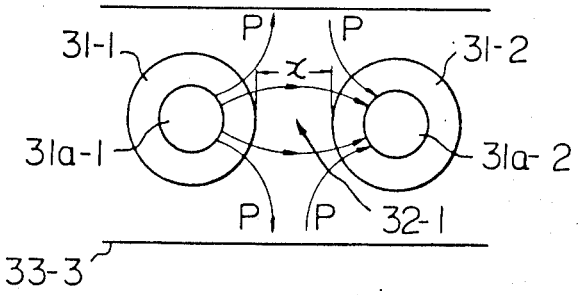
Fig. 3C PRIOR ART

The present dielectric filter is based upon the dielectric filter of FIGS. 3A through 3C in which a plurality of resonators with a conductive rod enclosed with a dielectric body are positioned on the common conductive wall of the conductive housing, and a pair of antennas are provided at both the extreme ends of the resonators to couple the filter with external input and output circuits. An air gap is provided between two adjacent resonators for effecting the coupling between them. The thickness of the dielectric body surrounding a conductive rod is enough to hold almost all the electromagnetic energy in the resonator except for the energy for coupling the resonator with the adjacent resonator. It should be noted that a conductive rod may be replaced by an elongated hole plated with conductive material provided in a dielectric body.

The present dielectric filter has at least the following three improvements as compared with the structure of FIGS. 3A through 3C.

(a) A dielectric body covering a center conductive rod of a resonator is a bulk body common to all the resonators with a plurality of linear grooves for providing a coupling between the two adjacent resonators. Said grooves operate as an air gap of the embodiment of FIGS. 3A through 3C.

(b) A trimming capacitor is provided at the free standing end of each resonator for finely adjusting the resonating frequency of each resonator.

(c) A conductive rod or a conductive film is provided between two adjacent resonators in the direction perpendicular to the resonators to improve the spurious characteristics of the filter.

Those three features or improvements are described separately for the sake of the simplicity of the explanation.

First, the feature (a) is described in accordance with FIGS. 4 through 10.

Figure 4:
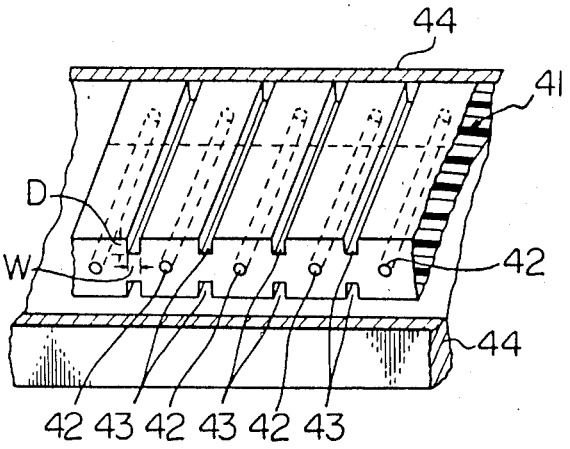
FIG. 4 shows the embodiment of the dielectric filter according to the present invention.

FIG. 4 shows the main portion of the filter according to the present invention, in which the reference numeral 41 is a common dielectric body, 42 is a linear hole provided in said dielectric body 41 so that each hole is parallel to one another, and the surface of the holes is plated with conductive material. The length of the hole 42 is approximately $\frac{1}{4}$ wavelength, but said length is a little shorter than said $\frac{1}{4}$ wavelength. Thus, the hole plated with conductive material works as a conductive rod of a resonator. The numeral 43 is a groove provided between the conductive rods or the holes 42. Said groove operates as an air gap 32-1 through 32-4 in FIG. 3A. The width and the depth of said groove 43 are W and D, respectively.

Figure 5:
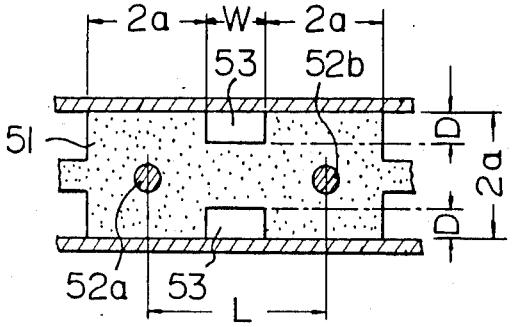
FIG. 5 is the explanatory drawing for the explanation of the operation of the filter of FIG. 4.
Figure 6:
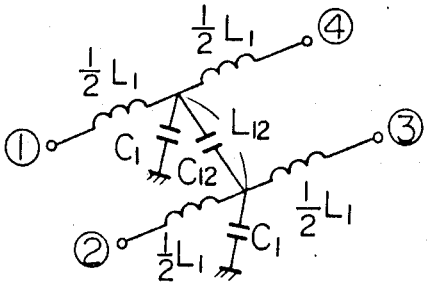
FIG. 6 is the equivalent circuit of the structure of FIG. 5.

FIG. 5 shows the enlarged cross section of the present filter, and FIG. 6 is an equivalent circuit of the filter of FIG. 5, in which $L_1$ is self inductance for unit length of a conductive rod, $L_{12}$ is mutual inductance for unit length of two conductive rods, $C_1$ is self capacitance between a conductive rod and a conductive housing for each unit length of a conductive rod, and $C_{12}$ is mutual capacitance between two adjacent conductive rods for unit length of a conductive rod.

The coupling coefficient $K_T$ between the $\frac{1}{4}$ wavelength resonators 52*a* and 52*b* is the sum of the magnetic coupling coefficient $K_L$ and the static coupling coefficient $K_C$, and is shown by the following equation.

$$K_T = L_{12(i)}/L_{1(i)} - C_{12(i)}/C_{1(i)} = K_L - K_C \quad (1)$$

The suffix (i) in the equation (1) shows the structure of FIG. 5 which has grooves and means *inhomogeneous* since the dielectric body is not uniform because of the presence of grooves. The structure with no groove is called *homogeneous.*

The values $L_{1(i)}$, and $L_{12(i)}$ in the equation (1) are equal to self inductance $L_{1(h)}$, and mutual inductance $L_{12(h)}$, respectively, for unit length of a resonator in a homogeneous structure in which a dielectric body is completely filled with dielectric material without grooves. The above relationship means that the magnetic coupling coefficient does not depend upon the presence of grooves, since the permeability of a dielectric body is 1. Said values $L_{1(h)}$ and $L_{12(h)}$ are expressed by the equations (2) and (3), respectively, in which self capacitance $C_{1(h)}$, mutual capacitance $C_{12(h)}$ for unit length of a resonator in homogeneous structure are used.

$$L_{1(i)} = L_{1(h)} = \epsilon_r \epsilon_0 \mu_0 \frac{C_{1(h)} + C_{12(h)}}{C_{1(h)}(C_{1(h)} + 2C_{12(h)})} \quad (2)$$

$$L_{12(i)} = L_{12(h)} = \epsilon_r \epsilon_0 \mu_0 \frac{C_{12(h)}}{C_{1(h)}(C_{1(h)} + 2C_{12(h)})} \quad (3)$$

where $\epsilon_r$, $\epsilon_0$, $\mu_0$ are the dielectric constant of the dielectric body, the dielectric constant of space, and the space permeability, respectively.

The coupling coefficient $K_{T(i)}$ between two adjacent resonators in the structure of FIG. 5 is derived from the above equations (1), (2) and (3), and the result is shown in the equation (4).

$$K_{T(i)} = C_{12(h)}/(C_{1(h)} + C_{12(h)}) - C_{12(i)}/(C_{1(i)} + C_{12(i)}) = K_L - K_C \quad (4)$$

It should be noted in the equation (4) that the magnetic coupling coefficient $K_L$ is independent from the structure of the dielectric body whether or not it is inhomogeneous (having grooves) or homogeneous (without grooves). In case of homogeneous structure without grooves, the values $C_{1(i)}$ and $C_{12(i)}$ in the equation (4) are equal to $C_{1(h)}$ and $C_{12(h)}$, respectively, and the magnetic coupling coefficient $K_L$ is equal to the static coupling coefficient $K_C$. Therefore, the total coupling coefficient of the filter is almost zero, and no filter is obtained.

Figure 7:
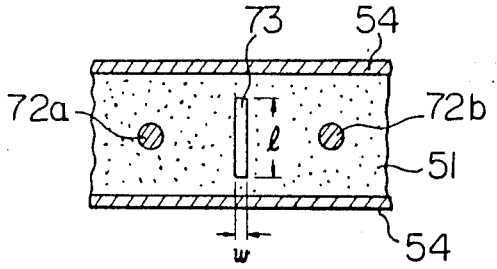
FIG. 7 is the modification of the filter of FIG. 4.

FIG. 7 shows the modification of the structure of FIG. 5, in which a single central groove 73 is provided between the resonators 72*a* and 72*b*, instead of a pair of grooves 53 in FIG. 5. The coupling coefficient between resonators is adjusted by the length l and the width W of the groove 73.

Figure 8:
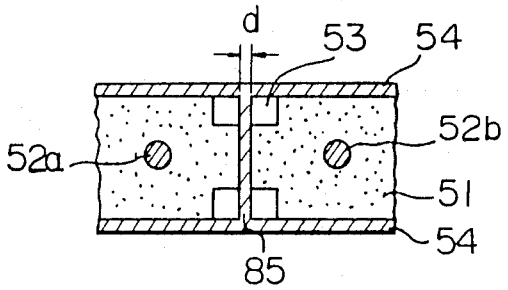
FIG. 8 is another modification of the filter of FIG. 4.

FIG. 8 is another modification, in which at least one conductive rod 85 is provided between the resonators. Those conductive rods 85 effect to adjust the coupling coefficient between the resonators by adjusting the thickness and/or the number of the rods. Those rods also effect to improve the spurious characteristics of the filter.

Figure 9:
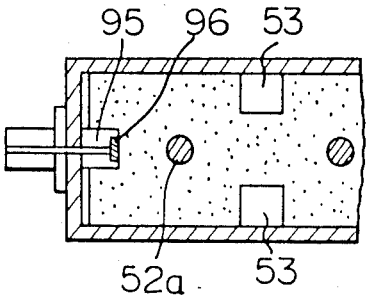
FIG. 9 is still another modification of the filter of FIG. 4.

FIG. 9 shows an antenna structure for coupling the filter with an external circuit. In FIG. 9, the numeral 95 is a recess provided in the dielectric body, and 96 is an electrode provided at the bottom of the recess 95. The coupling between the resonator with the rod 52*a* and the antenna (95, 96) is accomplished through the capacitance between the electrode 96 and the conductive rod 52*a*.

Figure 10:
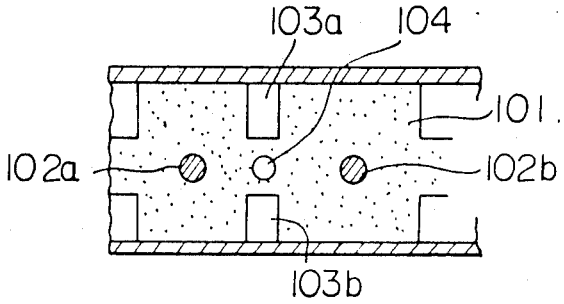
FIG. 10 is still another modification of the filter of FIG. 4.

FIG. 10 is another modification of the present filter, in which a linear inner hole 104 is provided for increasing the coupling coefficient between the resonators 102*a* and 102*b*. The external grooves 103*a* and 103*b* are also provided to couple the resonators.

The effect of the grooves in the above embodiments is to decrease the mutual capacitance $C_{12(i)}$ between resonators in the equation (4), and to decrease the static coupling coefficient $K_C$. On the other hand, the magnetic coupling coefficient $K_L$ does not depend upon the presence of the grooves. As a result, the grooves increase the total coupling coefficient $K_T$ which is the difference between the static coupling coefficient and the magnetic coupling coefficient. Thus, the filter with the desired bandwidth is designed with the proper coupling coefficients between each of the resonators.

The operational mode of the electro-magnetic wave in the resonators of the present filter is close to the TEM mode which is the operational mode of a coaxial cable. Since the coupling coefficient of the filter in the embodiments of FIGS. 4 through 10 is adjustable by adjusting merely the width and the depth of the grooves, the filter with the desired bandwidth is obtained easily. Since the dielectric body is a single bulk body common to all the resonators, the structure of the filter is simple, and assembling process is simplified.

Figure 1A:
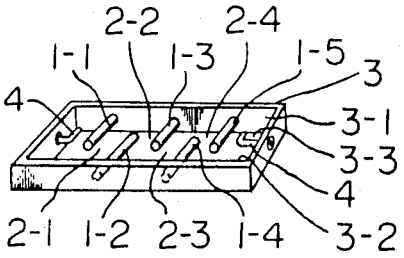
Fig. 1A PRIOR ART
FIG. 1A shows a prior interdigital filter.
Figure 1B:
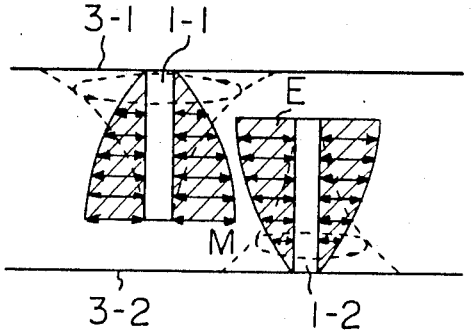
Fig. 1B PRIOR ART
FIG. 1B shows the coupling principle of the interdigital filter of FIG. 1A.
Figure 2:
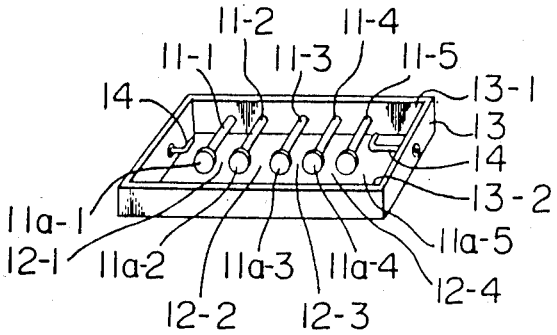
Fig. 2 PRIOR ART
FIG. 2 shows a prior comb line filter.
Figure 11A:
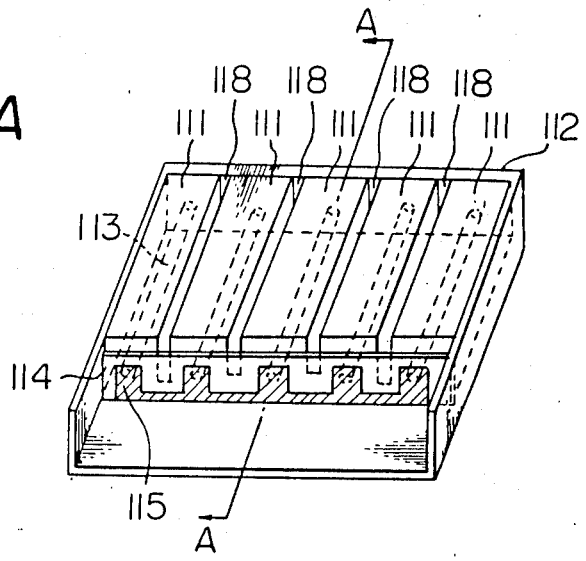
FIG. 11A is the structure of another embodiment of the filter according to the present invention.
Figure 11B:
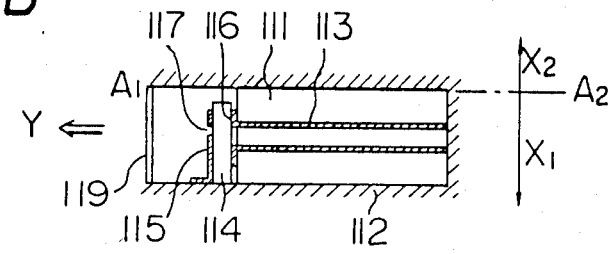
FIG. 11B is the cross section on line A—A of FIG. 11A.

Next, the feature (b) of the present filter is described in accordance with FIGS. 11A through 12. FIG. 11A shows a part of the perspective view of the present filter, in which the reference numeral 111 is a dielectric body for composing a resonator, 112 is a conductive housing, 113 is a conductive rod with the length approximately $\frac{1}{4}$ wavelength provided in the dielectric body 111, 114 is a thin opaque dielectric plate provided at the free end of the resonators, 115 is a conductive layer attached on said dielectric plate 114, 118 is a groove provided on the dielectric body 111 for providing the coupling between the resonators. FIG. 11B is the cross section at the line A—A of FIG. 11A. The numeral 116 is the extension of the center conductor 113 on the top of the dielectric body 111, 115 is a conductive layer provided on the dielectric plate 114 so that said layer 115 confronts with the extended portion 116 of the center conductor 113. Said conductive layer 115 is electrically coupled with the housing 112, or grounded. It should be appreciated that a center conductor 113 of a resonator is provided by plating conductive film of the inner surface of the hole in the dielectric body 111. The conductive layer 115, the dielectric plate 114, and the conductive portion 116 compose a capacitor, which is coupled with the resonator, and facilitates the fine adjusting of the resonating frequency of the resonator. Due to the presence of the capacitor, the length of the conductor rod 113 is a little shorter than $\frac{1}{4}$ wavelength. When a resonator is electrically excited, the free end of the resonator at which the capacitor is coupled has the maximum electric field, and the magnetic field is maximum at the other end of the resonator. as described in accordance with FIG. 1B. The reference numeral 117 is the cut out portion on the conductive layer 115.

The coupling between two adjacent resonators is provided by the presence of the groove 118 as is the case of the embodiment of FIG. 4.

As the conductive layer 115 is grounded to the housing 112, the earth current flows in the conductive layer 115. The deterioration of the non-load $Q_u$ of the resonator by said earth current is prevented if the area of the conductive layer 115 is larger than the cross section of the center rod 113. Said non-load $Q_u$ is also deteriorated by the displacement current in the dielectric plate 114. Therefore, in order to prevent the deterioration of the non-load $Q_u$ of the resonator by the displacement current, the loss in that dielectric plate 114 must be very small. One example of the material of the dielectric plate 114 for that small loss is alumina ($Al_2O_3$).

The capacitance is provided between the conductive layer 115 and the extended portion 116 of the center rod 113. Due to the presence of the conductive layer 115 which covers the top of the resonator, the electric field in the resonator does not leak in the direction arrowed by Y. Therefore, the drift of the resonating frequency by opening or closing a cover 119 of the filter is prevented. The resonating frequency of each resonator is adjusted by adjusting the capacitance between the electrodes 115 and 116.

The adjustment of the capacitance for adjusting the resonating frequency is accomplished by trimming the area of the outer electrode 115 by using a laser beam. By using the above process for adjusting the capacitance, the resonating frequency of the resonator is adjusted without changing or adjusting the resonator itself or the conductive rod 113.

Figure 11C:
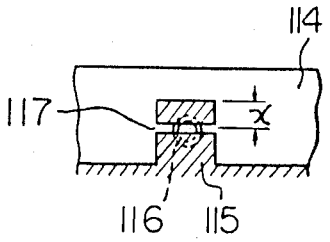
FIG. 11C shows the trimming of an electrode of the filter of FIG. 11A, FIG. 11D and FIG. 11E show modifications of the filter of FIG. 11A.

In one embodiment for adjusting the capacitance, the grounded conductive layer 115 is trimmed by using a laser beam as shown in FIG. 11C, in which the conductive layer 115 is made of opaque alumina ($Al_2O_3$). The electrode 115 is cut by the length (x) as shown in FIG. 11C, in which the reference numeral 117 is the cut out trace of a laser.

FIG. 12 shows the experimental result of the trimming of the electrode. In FIG. 12, the horizontal axis shows length (x) of FIG. 11C, and vertical axis shows the frequency shift $\Delta f_0$ of the resonator (left side), and the un-loaded $Q_u$ of the resonator (right side). As shown in FIG. 12, the sensitivity of the frequency change is 7.6 MHz/mm. That is to say, when the electrode 115 is cut by 1 mm (x=1), the resonating frequency changes by 7.6 MHz. The allowable error of the resonating frequency in this kind of filter is ±0.02% in general, therefore, when the center frequency of the filter is 800 MHz, that allowable error is ±160 KHz. On the other hand, the width of the laser trace 117 is usually 20 μm. Therefore, the error of the resonating frequency by the width of the laser trace is;

$$7.6\ \text{MHz/mm} \times 0.02 = 1.52\ \text{KHz}\ (\pm 76\ \text{KHz})$$

Therefore, it should be appreciated that the accuracy of the resonating frequency of the resonator is satisfactory in spite of the error by the laser trace.

It should be appreciated also in FIG. 12 that the un-loaded $Q_u$ of the filter does not deteriorate when the electrode 115 is trimmed by a laser beam.

The dielectric plate 114 is opaque for the wavelength of a laser beam so that a laser beam does not deteriorate the dielectric body 111 by illuminating the same directly. If the dielectric body 111 of the resonator is illuminated by a strong laser beam directly, the ceramic (for instance $M_gT_iO_3$ type ceramic) is deteriorated since $T_i$ in ceramic is changed to something like an alloy, and the dielectric loss of the dieletric body increases. In the case of alumina, the thickness of the dielectric plate 114 must by thicker than 1.6 mm in order to protect the dielectric body 111 from a laser beam.

When the cover 119 of the housing is transparent, the trimming is accomplished by illuminating the electrode with a laser beam from the outside of the resonator.

As a modification of the embodiment of FIG. 11C, a laser beam may provide a hole on a conductive plate, instead of cutting the same.

The dielectric plate 114 may be separated for each of the resonators, although the embodiment of FIG. 11A shows a single continuous elongated dielectric plate common to all the resonators.

Figure 11D:
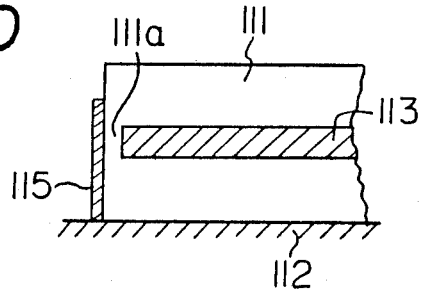
FIG. 11F is another modification of the filter of FIG. 11A, FIG. 11G and FIG. 11H are alternatives of FIG. 11F.

FIG. 11D shows another alternative, in which the dielectric body 111 does not pass through, but has the bottom wall 111*a* on which the conductive layer 115 is attached.

Figure 11E:
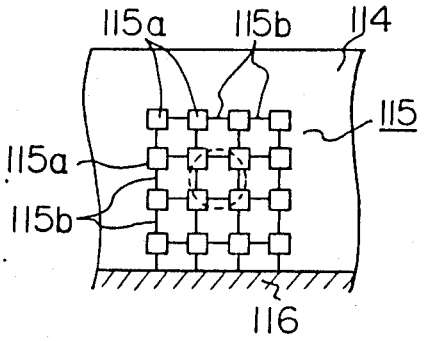

FIG. 11E shows still another alternative, in which a conductive layer 115 is separated to a plurality of cells 115*a* which are electrically coupled with one another by thin lead lines 115*b* plated on a dielectric plate. In the embodiment of FIG. 11E, the trimming of the capacitance is accomplished merely by cutting the thin lead lines 115*b*.

Figure 11F:
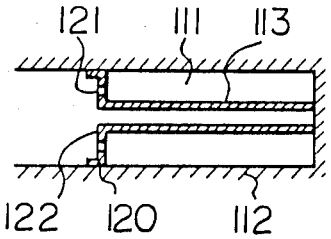
Figure 11G:
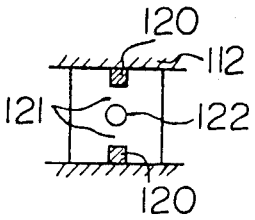
Figure 11H:
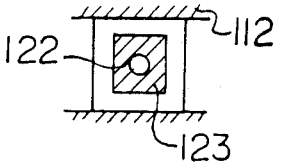

FIG. 11F is still another modification of the filter of FIG. 11A, and the feature of the filter of FIG. 11F is that no dielectric plate 114 is provided and a trimming electrode 122 is attached directly on the dielectric body 111. And, said trimming electrode 122 and the ground electrode 120 provide the capacitance between them. The reference numeral 121 shows the trimmed portion of the trimming electrode 122. Two alternatives for the trimming are possible as shown in FIGS. 11G and 11H. In FIG. 11G, a pair of ground electrodes 120 confront with the electrode 122 which is coupled with the inner conductor 113, and the ground electrodes 120 is trimmed to adjust the resonating frequency of the resonator. On the other hand, in the embodiment of FIG. 11H, no ground electrode is provided, but the center electrode 122 has the flange 123, which is trimmed to adjust the resonating frequency. It should be noted that the modifications in FIGS. 11F through 11H have no opaque dielectric plate 114. Therefore, a trimming operation can not be carried out by using a laser beam since a laser beam would deteriorate a dielectric body of a resonator, but the trimming operation is accomplished by mechanically cutting a trimming electrode.

Next, the feature (c) of the present filter is described in accordance with FIGS. 13A through 15B.

Figure 16:
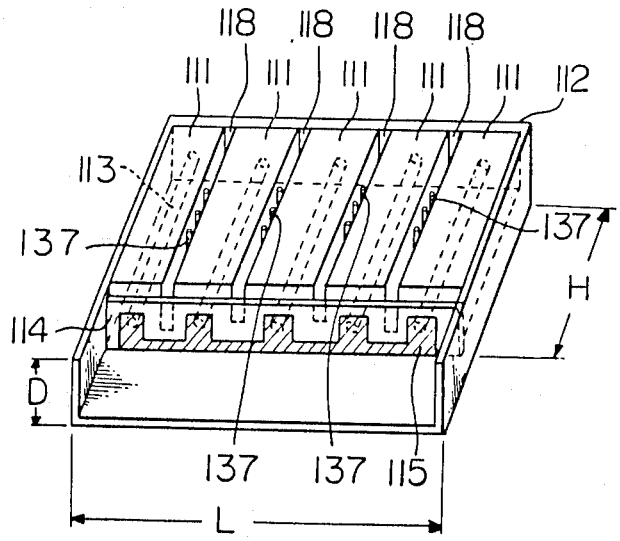
FIG. 16 is still another embodiment of the dielectric filter according to the present invention.

The undesired signals in the present filter include spurious signals of the coaxial mode, and spurious signals of the waveguide mode. The frequency of the spurious signals of the coaxial mode may be higher than $3f_0$ (where $f_0$ is the resonating frequency) when the ratio D/d (where D is the external diameter of a dielectric body, and d is the inner diameter of a dielectric body) is properly designed. The frequency of the spurious signals of the waveguide mode depends upon the dimentions of the housing of the filter, and the resonating wavelength is obtained by the following formula.

$$\lambda_0 = 2\sqrt{\epsilon_w} \Big/ \sqrt{(m/H)^2 + (n/D)^2 + (a/L)^2}$$

where $\epsilon_w$ is the equivalent dielectric constant of the dielectric body, m is the number of the wavelength along the height H of a resonator, n is the number of the wavelengths along the height of the housing, D is the height of the housing (see FIG. 16), and a is the number of the wavelengths along the length (L) of the housing (see FIG. 16). The frequency of the spurious signals of the waveguide mode according to the above equation may be less than $2f_0$, which deteriorates the attenuation characteristics of the filter.

FIGS. 13A, 13B, 13C, and 13D show embodiments, in which the numeral 131 is the conductive housing, 132 is the dielectric body, 133 is the inner conductor, 134 is an input/output terminal, 136 is a conductive film attached on the dielectric body, and 137 is a conductive rod provided in the grooves between the resonators. The conductive film or the conductive rod extends perpendicular to the inner conductor of the resonator, and both the ends of the conductive film or the conductive rods are grounded to the housing 131. The diameter of the conductive rod 137 is 0.8–1.6 mm, and 2–4 number of conductive rods are positioned around the middle of the height H of the resonator.

FIGS. 14A, B show the effect of the conductive film or the conductive rod of the filter in which the center frequency is 800 MHz band. The theoretical spurious resonating frequency of the $TE_{101}$ mode is 1.468 GHZ, which approximately coincides with the experimental spurious frequency 1.56 GHz. As far as the $TE_{101}$ mode is concerned, it is apparent that the spurious level decreases as the number of the conductive rods increases as shown in FIG. 14B. That is to say, the electric field by the waveguide mode $TE_{101}$ decreases as the number of the conductive rods increases.

FIGS. 15A, B show that the effect of the conductive rods depends upon the position of the same. In the experiment of FIGS. 15A, B, the diameter of the conductive rods is 1.2 mm, and three conductive rods arranged with the duration of 20 mm are used. In FIG. 15A, the position (1) means that three conductive rods are positioned a the portion (1) which is close to the free standing end of the resonator, the position (3) means that three conductive rods are positioned around the middle of the height (H) of the resonator, and the position (2) is between the position (1) and the position (2). As is apparent from FIGS. 15A, B, the position (3) which is close to the middle of the resonator is the best for attenuating the undesired spurious mode. The distance between the position (1) and the position (3) is about 4 mm, and the attenuation at the position (1) is worse by 10 dB as compared with that of the position (3).

FIG. 16 shows the perspective view of the present dielectric filter which has all the three features of the present invention. In FIG. 16, the dielectric body 111 with the grooves 118 are positioned in the housing 112, and the inner conductor 113 is provided by plating the inner surface of the hole in the dielectric body 111 with the conductive material. The opaque dielectric plate 114 is attached at the top of the free standing end of the resonators, and the conductive layer 115 for trimming is attached on the surface of the dielectric plate 114. An input/output antenna is not shown in FIG. 16. The conductive rods 137 are arranged in the grooves so that those conductive rods are perpendicular to the inner conductor 113, and those conductive rods are positioned approximately at the middle of the height H inner conductor 113.

From the foregoing, it will now be apparent that a new and improved dielectric filter has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A dielectric filter comprising:

(a) a conductive closed housing, (b) at least two resonators fixed in said housing, (c) input means for coupling one end resonator of said at least two resonators to an external circuit, and output means for coupling the other end resonator of said at least two resonators to an external circuit, (d) each resonator comprising an elongated linear inner conductor one end of which is fixed commonly at the bottom of said housing, and the other end of which is free standing with respect to the housing and a dielectric body surrounding the inner conductors, (e) the thickness of said dielectric body surrounding said inner conductor being sufficient to hold all the electromagnetic energy in the dielectric body except for the energy for coupling between two adjacent resonators, (f) an unplated air gap groove provided between adjacent resonators;

(g) said dielectric body surrounding the inner conductors being a bulk body common to all the resonators in which said unplated air gap groove between two adjacent resonators extends parallel to the conductors the entire distance along the body from the free standing end of the body to the fixed end of the body and in which the depth of said groove extends only a portion of the thickness of said body, and said groove operates as said air gap between resonators for effecting static coupling between the resonators independently of magnetic coupling, and (h) a conductive layer electrically isolated from the inner conductors and adapted to be trimmed and spaced from the end of the dielectric body which is free standing with respect to the housing, said conductive layer having a respective extended portion associated with each resonator and covering at least a portion of the end of the respective inner conductor of each resonator so that a capacitor is formed between said conductive layer and the inner conductor of each resonator wherein the respective extended portions are directly electrically coupled to each other.

2. A dielectric filter according to claim 1, wherein said dielectric body is made of $M_gT_iO_3$ type ceramic.

3. A dielectric filter according to claim 1, further comprising an elongated conductive means provided in said groove so that said elongated conductive means is perpendicular to an inner conductor of a resonator.

4. A dielectric filter according to claim 3, wherein said elongated conductive means is a conductive film.

5. A dielectric filter according to claim 3, wherein said elongated conductive measns is a conductive rod.

6. A dielectric filter according to claim 1, wherein said conductive layer is attached on a free standing end of the dielectric body, and said conductive layer is adapted for trimming to adjust the capacitance of the capacitor.

7. A dielectric filter according to claim 6, wherein said conductive layer is composed of a first layer coupled with an inner conductor of a resonator, and a second layer coupled with the housing, and the second layer is subject to trimming.

8. A dielectric filter according to claim 6, wherein said conductive layer has a layer coupled with an inner conductor, said layer is subject to be trimmed, and the capacitance is provided between said layer and the housing.

* * * * *